US008875790B2

(12) United States Patent
Baski

(10) Patent No.: US 8,875,790 B2
(45) Date of Patent: Nov. 4, 2014

(54) METHOD AND SYSTEM FOR FRACKING AND COMPLETING WELLS

(75) Inventor: Henry A. Baski, Denver, CO (US)

(73) Assignee: Baski, Inc., Denver, CO (US)

( * ) Notice: Subject to any disclaimer, the term of this patent is extended or adjusted under 35 U.S.C. 154(b) by 268 days.

(21) Appl. No.: 13/468,362

(22) Filed: May 10, 2012

(65) Prior Publication Data

US 2013/0299174 A1 Nov. 14, 2013

Related U.S. Application Data

(60) Provisional application No. 61/484,792, filed on May 11, 2011.

(51) Int. Cl.
*E21B 43/26* (2006.01)

(52) U.S. Cl.
USPC ..... 166/308.1; 166/177.5

(58) Field of Classification Search
USPC ..... 166/308.1, 177.5, 187
See application file for complete search history.

(56) References Cited

U.S. PATENT DOCUMENTS

| | | | | |
|---|---|---|---|---|
| 3,529,667 | A | 9/1970 | Malone | |
| 4,408,485 | A | 10/1983 | McGill | |
| 4,455,027 | A | 6/1984 | Baski | |
| 4,614,346 | A | 9/1986 | Ito | |
| 4,892,144 | A | 1/1990 | Coone | |
| 5,103,911 | A | 4/1992 | Heijnen | |
| 5,316,081 | A | 5/1994 | Baski et al. | |
| 5,517,854 | A | 5/1996 | Plumb et al. | |
| 5,778,982 | A | 7/1998 | Hauck et al. | |
| 6,073,906 | A | 6/2000 | Wallace | |
| 6,158,506 | A | 12/2000 | Carisella | |
| 6,273,195 | B1 | 8/2001 | Hauck et al. | |
| 6,338,466 | B1 | 1/2002 | Wallace et al. | |
| 6,615,926 | B2 | 9/2003 | Hester et al. | |
| 6,691,786 | B2 | 2/2004 | Patel | |
| 6,811,353 | B2 | 11/2004 | Madison | |
| 6,938,698 | B2 | 9/2005 | Coronado | |
| 7,278,486 | B2 * | 10/2007 | Alba et al. | 166/308.1 |
| 7,721,799 | B2 | 5/2010 | Baski | |
| 2005/0061508 | A1 | 3/2005 | Surjaatmadja | |
| 2008/0179055 | A1 | 7/2008 | Baski | |
| 2011/0067870 | A1 | 3/2011 | East, Jr. | |

OTHER PUBLICATIONS

International Application No. PCT/US2012/037273, filed May 10, 2012, Search Report and Written Opinion dated Jul. 27, 2012, pp. 1-17.

* cited by examiner

*Primary Examiner* — William P Neuder
(74) *Attorney, Agent, or Firm* — Stephen A. Gratton

(57) ABSTRACT

A method for fracking and completing a well having a well bore through a formation includes packer jack fracking the formation using a packer to form a packer fractured formation moving the packer to seal the packer fractured formation, and hydraulically fracturing the packer fractured formation by injecting a fracking fluid through the packer. These steps can then be repeated through successive intervals of the formation. To complete a new well, a perforated liner can be placed in the well bore to direct the fracking fluid into the packer fractured formation. To complete an existing or a new well having a cemented liner the packer jack fracking step can also be used to break apart the liner and form at least one opening to provide a flow path for the fracking fluid. A system includes a perforated liner and a packer configured to fracture and seal successive intervals.

20 Claims, 16 Drawing Sheets

METHOD AND SYSTEM FOR FRACKING AND COMPLETING WELLS

CROSS REFERENCE TO RELATED APPLICATIONS

This application claims priority from provisional application No. 61/484,792 filed on May 11, 2011, which is incorporated herein by reference.

BACKGROUND

Oil and gas wells can be treated by fracking (hydraulic fracturing) and chemical injections to increase production. The fracking process occurs after a bore hole has been formed through a formation, and is sometimes referred to as completing the well. Fracking forms fractures in a formation that are typically oriented parallel to the maximum induced stresses in the formation and perpendicular to the minimum induced stresses in the formation. Following (or during) fracking, a granular proppant material can be injected into the fractures to hold them open. The fractures provide low resistance flow paths through the formation into the well liner. Chemical injections can also be used separately, or in combination with fracking, to increase flow capacity by dissolving materials or changing formation properties.

One fracking method involves drilling a horizontal well bore, and inserting a liner into the well bore. The annulus between the liner and the well bore is then filled with cement. The liner is then perforated in sections of typically from 100 to 1000 feet using a perforating device. In addition, a packer on a coiled tubing string can be placed at the lower end of the segment and actuated to establish a hydraulic seal. Hydraulic fracturing can then be performed in the sealed perforated segment. The packer can then be released and moved to repeat the process.

This prior art fracking method is expensive as the well bore is relatively large and the liner must be made of high strength steel and cemented in place. In addition, in non-cemented liners, the packers have a limited life expectancy and a low reliability. Also due to the complexity of the method, only a limited number of stages can be performed. For example, a 4000 feet horizontal well bore can typically only be treated in 10 stages of 400 feet with each stage having 3-4 perforated zones. Another problem is that the high pressures needed for hydraulic fracturing can damage cemented liners.

The present disclosure is directed to a method and system for fracking and completing wells that is better, faster and cheaper than prior art methods and systems. In particular, lower cost materials are used, and the downhole perforating operation and external liner pockets are eliminated. Further, more stages can be performed, more fractures can be formed, more proppant can be injected and higher flow rates can be achieved.

However, the foregoing examples of the related art and limitations related therewith are intended to be illustrative and not exclusive. Other limitations of the related art will become apparent to those of skill in the art upon a reading of the specification and a study of the drawings.

SUMMARY

A method for fracking and completing a well having a well bore through a formation includes the steps of: packer jack fracking a first interval of the formation using a packer to form a first packer fractured formation, deflating and moving the packer to a second interval in the formation; inflating the packer to seal the first packer fractured formation; hydraulically fracturing the first packer fractured formation by injecting a fracking fluid through the packer, and then repeating the packer jack fracking step, the deflating and moving the packer step, the inflating the packer step and the hydraulically fracturing step through successive intervals of the formation. To complete a new well, a perforated liner can be placed in a well bore to direct the fracking fluid into the packer fractured formation. To complete an existing or new well having a cemented liner, the packer jack fracking step can also be used to break apart the liner to provide flow paths for the fracking fluid through the casing into the packer fractured formation.

For completing a new well, the method can include the steps of: installing a perforated liner in the well bore having a plurality of pre-formed openings therethrough; installing a packer in the perforated liner at a first interval in the formation; packer jack fracking the first interval using the packer to define a first packer fractured formation; deflating and moving the packer to a second interval in the formation; inflating the packer to seal the first packer fractured formation; hydraulically fracturing the first packer fractured formation by injecting a fracking fluid through the packer and the openings in the perforated liner to form a first hydraulically fractured formation; and packer jack fracking the second interval using the packer to define a second packer fractured formation. The hydraulically fracturing step, the deflating and moving step, the inflating step, and the packer fracturing step of the method can then be repeated through as many intervals as is necessary. Optionally, rather than a single packer, a second packer can be used to seal the intervals. For completing an existing or a new well having a liner cemented in the well bore, the method can include essentially the same steps, but without installing the perforated liner and with the packer jack fracking step performed to break at least one opening through the cemented liner.

A system for fracking and completing a well having a well bore through a formation comprises: a perforated liner in the well bore having a plurality of pre-formed openings therethrough, a high pressure drill pipe, a packer actuation tool and a packer in the perforated liner configured to fracture and seal successive intervals in the formation.

BRIEF DESCRIPTION OF THE DRAWINGS

Exemplary embodiments are illustrated in the referenced figures of the drawings. It is intended that the embodiments and the figures disclosed herein be considered illustrative rather than limiting.

FIG. 15A is a schematic cross sectional view taken along section line 15A-15A of FIG. 15 illustrating formation of the second packer fractured formation.

DETAILED DESCRIPTION

Figure 1:
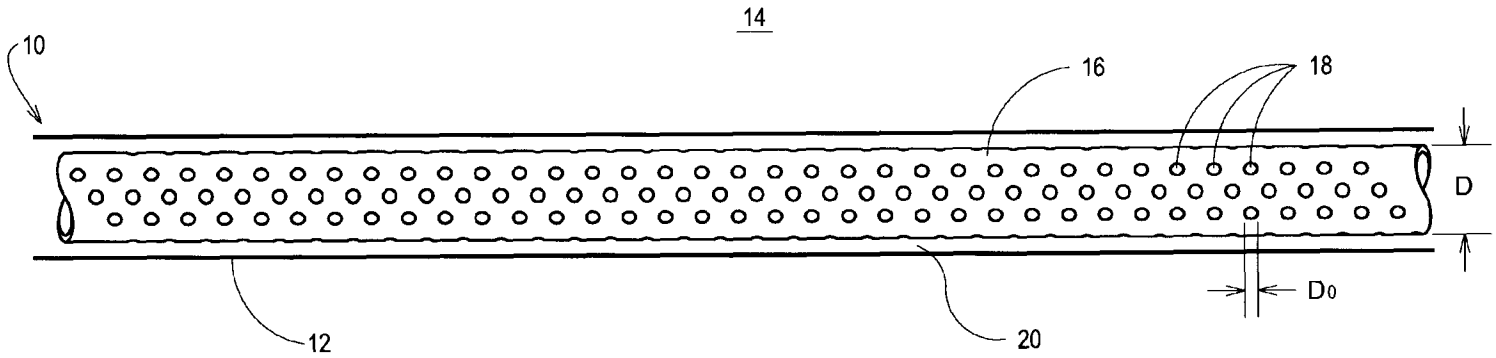
FIG. 1 is a schematic cross sectional view illustrating the step in the method of installing a perforated liner in the bore hole.

FIGS. 1-6 illustrate steps in a method for fracking and completing a well 10. The well 10 can comprise an oil and gas well or alternately another type of well, such as another gas or liquid well such as a recharge water well. Referring to FIG. 1, the well 10 includes a well bore 12 that extends from a ground surface into a geological formation 14 at a required depth of typically from several hundred to several thousand feet. The well bore 12 extends through the geological formation 14 in a generally horizontal direction. The well bore 12 can also include a vertical segment, which for simplicity is not shown. The well bore 12 can be smaller than in a conventional oil and gas well. For example, a representative diameter of the well bore 12 can be about 6 inches to 8 inches.

As shown in FIG. 1, the method includes the step of installing a perforated liner 16 in the well bore 12 having a plurality of pre-formed openings 18 therethrough. The perforated liner 16 can comprise metal pipe that has been formed or machined with the openings 18 through the sidewalls, and attached in lengths by welding or threaded connections. As the perforated liner 16 has no pressure requirements, it can be made of low strength steel with seams, rather than high pressure seamless steel as with a conventional well liner. Further, the perforated liner 16 can be made relatively cheaply relative to a well liner perforated with an in-hole perforating device, and does not require cementing as with a conventional perforated well liner.

As shown in FIG. 1, the diameter D of the perforated liner 16 can be slightly less than the diameter of the well bore 12, such that an annulus 20 is formed between the perforated liner 16 and the well bore 12. A representative diameter D of the perforated liner 16 can be about 5 inches for a 6.25 to 6.75 inch horizontal well bore, but other diameters for these elements can be used. A diameter Do of the openings 18 can be selected as required with from ⅛ inch to ¾ inch being representative. Further, the density of the openings 18 can be selected as required with up to 500 openings per linear foot being representative. This density is larger than for openings formed in a conventional well liner by a down-hole perforating device. The larger number of openings 18 provides reduced fracturing flow resistances and increased production flow rates compared to a conventional perforated well liner. The openings 18 can also be formed with chamfered edges to further reduce flow resistances and increase flow rates.

Figure 2:
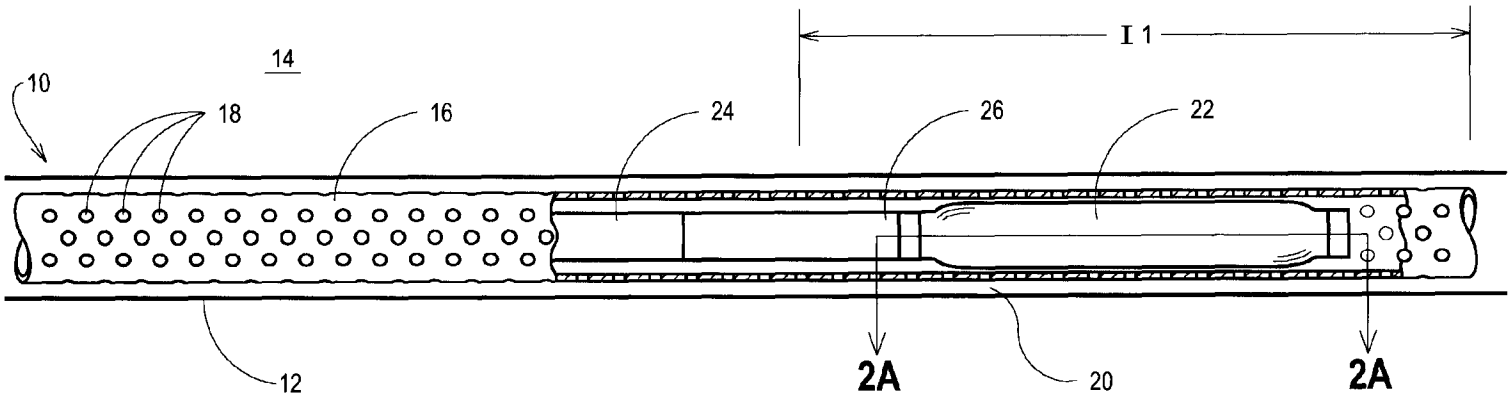
FIG. 2 is a schematic cross sectional view illustrating the step in the method of installing a packer at a first interval of the formation.

Referring to FIG. 2, the method also includes the step of installing a packer 22 in the perforated liner 16 at a first interval I1 in the formation 14, which is configured to perform a packer jack frac. As used herein, the term "packer jack frac" refers to a fracturing process that depends on a mechanical jacking force exerted on the formation 14 by the packer 22. By way of example, with the packer 22 inflated to a pressure of from 10,000 psia to 30,000 psia, enough force is produced to fracture the formation 14. Further details of the packer jack frac will become more apparent as the description proceeds.

Figure 2B:
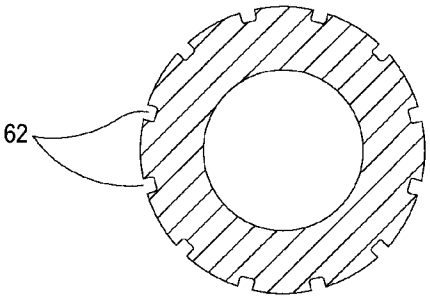
FIG. 2B is a schematic cross sectional view with parts removed taken along section line 2B-2B of FIG. 2A illustrating a grooved outer cover of the packer.
Figure 2A:
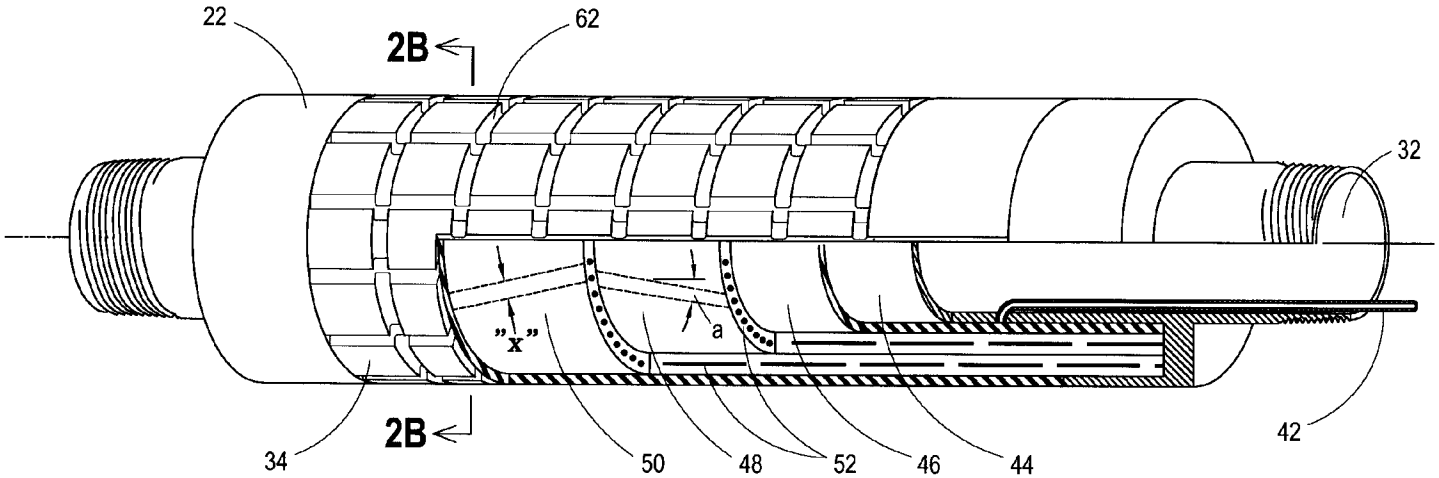
FIG. 2A is a schematic perspective view of the packer taken along section line 2A-2A of FIG. 2 and partially cut away to illustrate a reinforced inflatable element of the packer.

The packer 22 is attached to a high pressure tubular 24 and is controlled by a packer actuation tool 26. The packer 22 can comprise a fixed head inflatable packer or a sliding head inflatable packer. One suitable packer is described in U.S. Pat. No. 5,778,982, which is incorporated herein by reference. Other suitable packers are commercially available from Baski Inc. of Denver, Colo. As shown in FIG. 2A, the packer 22 includes a tubular packer mandrel 32 and an inflatable element 34 attached to the packer mandrel 32 at both ends connected to an inflation tube 42. The packer 32 is shown in an uninflated condition in FIG. 2A. The inflatable element 34 comprises a multi layered structure formed of separate layers or plies of resilient elastomeric materials. More specifically, the inflatable element 34 includes an inner layer 44, middle layers 46, 48 and outer layer 50. As shown in FIG. 2B, the outer layer 50 of the inflatable element 34 can include a plurality of radially spaced circumferential grooves 62 having a desired depth configured to provide a higher frictional force for anchoring the packer 22 to the well bore 12 (or to a liner 58 as will be hereinafter described). This permits higher forces to be applied to the formation 14 by the packer 22 as anchoring friction is maximized due to a higher pressure being applied to the well bore 12 or the perforated liner 16. A packer having an outer member with a grooved construction is further described in U.S. Pat. No. 7,721,799, which is incorporated herein by reference.

As also shown in FIG. 2A, the middle layers 46, 48 can comprise an elastomeric base material reinforced with reinforcing material 52. The reinforcing material 52 can comprise fibers, cable or cord embedded in the elastomeric base material at a desired spacing "x" and a desired angle "a". The construction of the inflatable element 34 allows high pressures and mechanical jacking forces to be achieved. In addition, the inflatable element 34 is designed to return to its uninflated shape for moving the packer 22 to other locations in the well bore 12. Further, the construction of the inflatable element 34 permits the packer 22 to be easily cycled from an inflated to an uninflated condition to cycle the mechanical jacking forces.

The high pressure tubular 24 can comprise lengths of steel tubing that are joined together by threaded connections. In addition, to placing the packer 22 at a desired location, the high pressure tubular is designed to contain the fracking fluid 30 during a hydraulic fracturing step to be hereinafter described. The packer actuation tool 26 is configured to inflate and deflate the packer 22 upon manipulation of the tubular 24 from the surface. This type of tool is also commercially available from Baski Inc. of Denver, Colo.

Figure 3B:
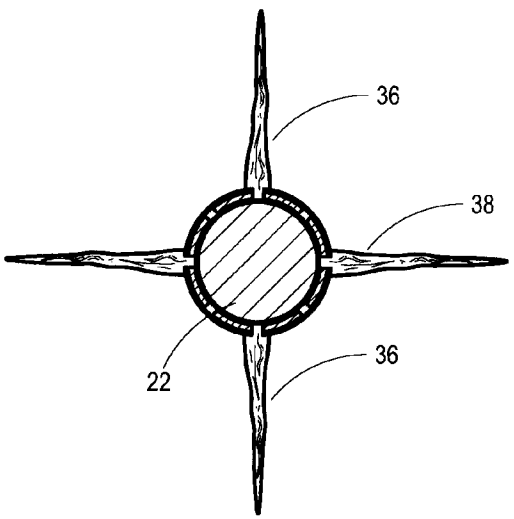
FIG. 3B is a schematic cross sectional view taken along section line 3B-3B of FIG. 3 illustrating primary and secondary packer jack fracs in the first packer fractured formation.
Figure 3A:
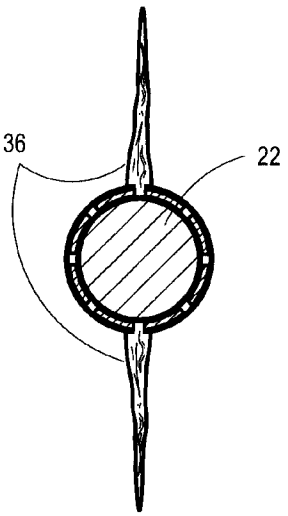
FIG. 3A is a schematic cross sectional view taken along section line 3A-3A of FIG. 3 illustrating primary packer jack fracs in the first packer fractured formation.
Figure 3:
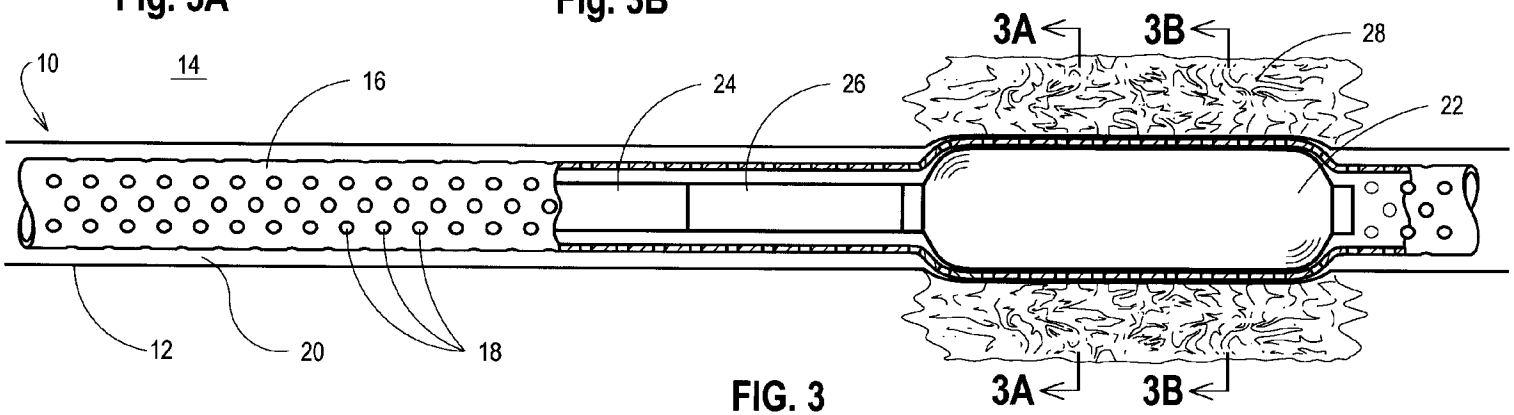
FIG. 3 is a schematic cross sectional view illustrating the step in the method of packer jack fracking using the packer to form a first packer fractured formation.
Figure 4:
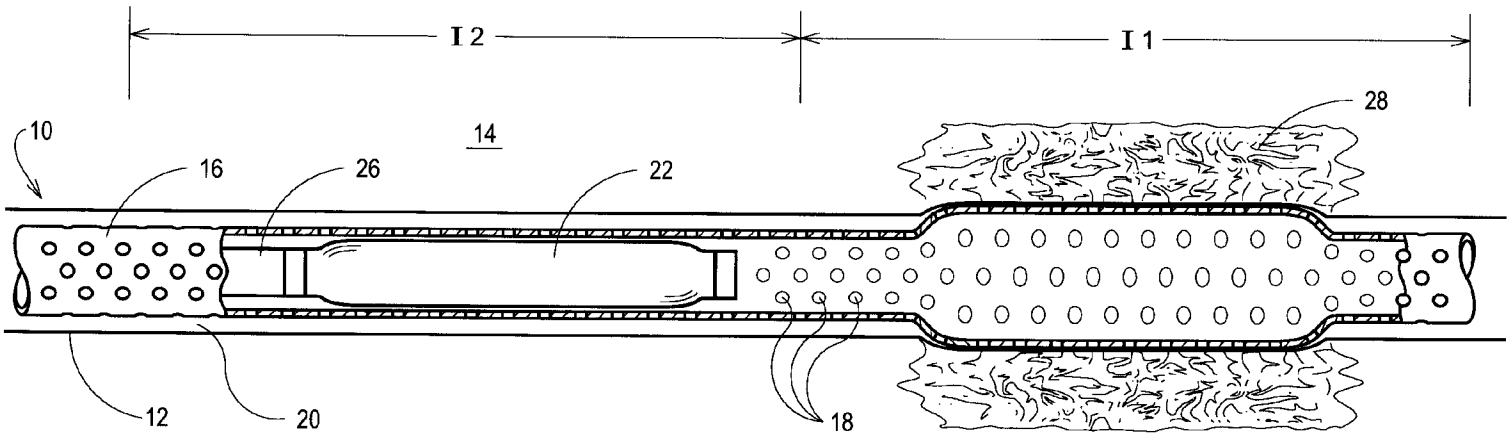
FIG. 4 is a schematic cross sectional view illustrating the step in the method of deflating and moving the packer to a second interval in the formation.

Referring to FIG. 3, the method also includes the step of packer jack fracking the first interval I1 using the packer 22 to define a first packer fractured formation 28. This step can be performed by inflating the packer 22 to a desired pressure of from 10,000 psia to 30,000 psia for a desired time period of from minutes to hours. This step can also be performed by cycling the packer 22 from an uninflated to an inflated condition over a selected cycle time period of from seconds to hours. As shown in FIGS. 3A and 3B, the packer jack fracking step forms primary packer jack fracs 36 and possibly secondary packer jack fracs 38. The primary packer jack fracs 36 are oriented generally perpendicular or orthogonal to the ground surface. The secondary packer jack fracs 38 are oriented generally parallel to the ground surface. As shown in FIG. 4, the perforated liner 16 has also been deformed in the first packer fractured formation 28.

Referring to FIG. 4, the method also includes the step of deflating and moving the packer 22 to a second interval 12 in the formation 14. The intervals I1 and 12 can be adjacent to one another or can be spaced with a desired spacing.

Figure 5:
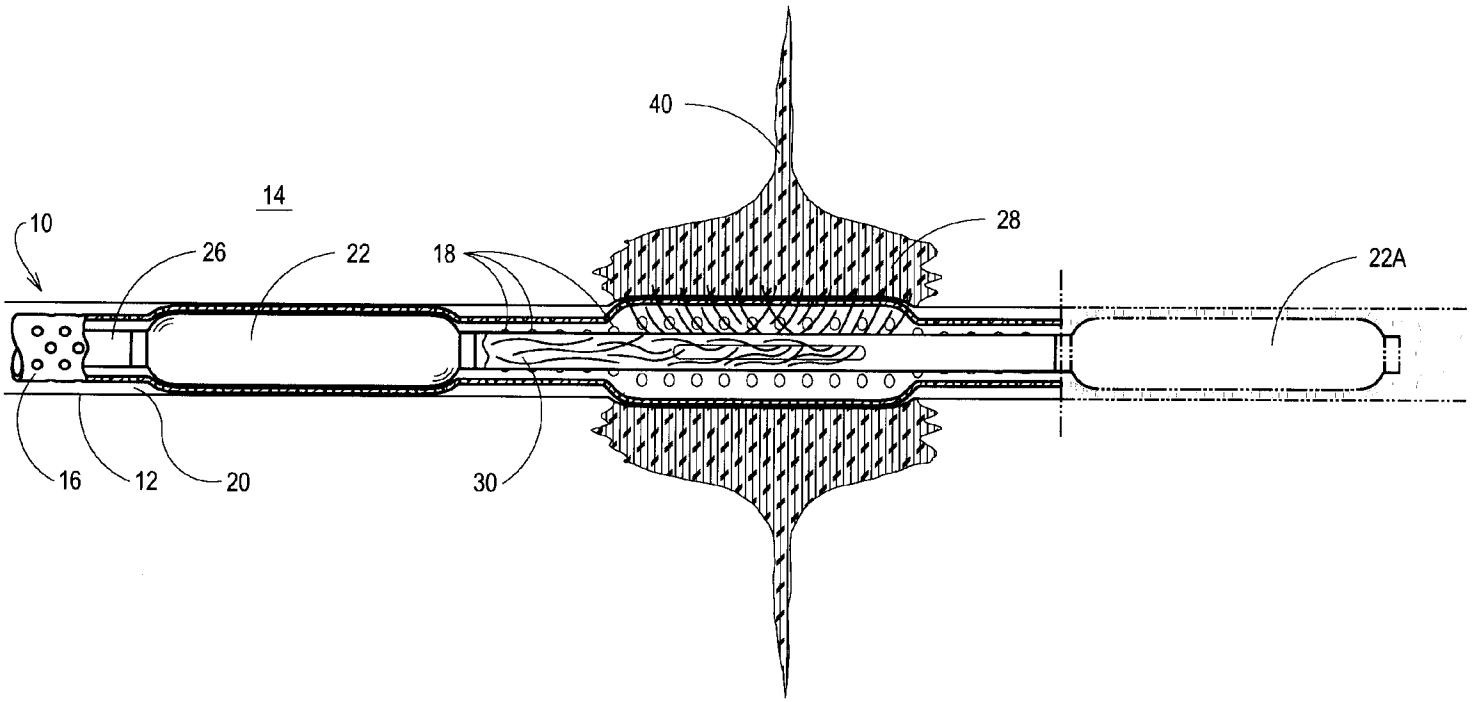
FIG. 5 is a schematic cross sectional view illustrating the step in the method of hydraulically fracturing the first packer fractured formation by inflating the packer to seal the bore hole and injecting a fracking fluid through the packer and the openings in the perforated liner to form a first hydraulically fractured formation with an optional step in the method of using a second packer to seal the first hydraulically fractured formation shown in phantom lines.

Referring to FIG. 5, the method also includes the step of inflating the packer 22 to seal the first packer fractured formation 28 for the subsequent hydraulic fracturing step. Preferably this step is performed such that plastic deformation of the perforated liner 16 occurs as indicated by the deformed outwardly bulging portion of the liner 16 in FIG. 5. The packer 22 seals the up hole end of the well bore 12 proximate to the second interval 12. The down hole end of the well bore 12 can be unsealed, or optionally, as shown by the phantom lines in FIG. 5 a second packer 22A can be used to seal the down hole end of the well bore 12. The second packer 22A can be spaced from the packer 22 with a required spacing, and can be placed and controlled using a second passageway, which for simplicity is not shown. With this method of control, the second packer 22A can be attached to the same high pressure tubular 24 and packer actuation tool 26 as the packer 22.

As also shown in FIG. 5, the method also includes the step of hydraulically fracturing the first packer fractured formation 28 by injecting a fracking fluid 30 through the packer 22 and the openings 18 in the perforated liner 16 to form a first hydraulically fractured formation 40. During this step, the packer 22 seals the up hole end of the well bore 12. In addition, the fracking fluid 30 can be injected from the surface through the high pressure tubular 24, through the packer 22 and through the openings 18 in the perforated liner 16 into the first packer fractured formation 28. In addition to the fracking fluid 30, chemicals and proppants can also be injected into the first hydraulically fractured formation 40.

Figure 6:
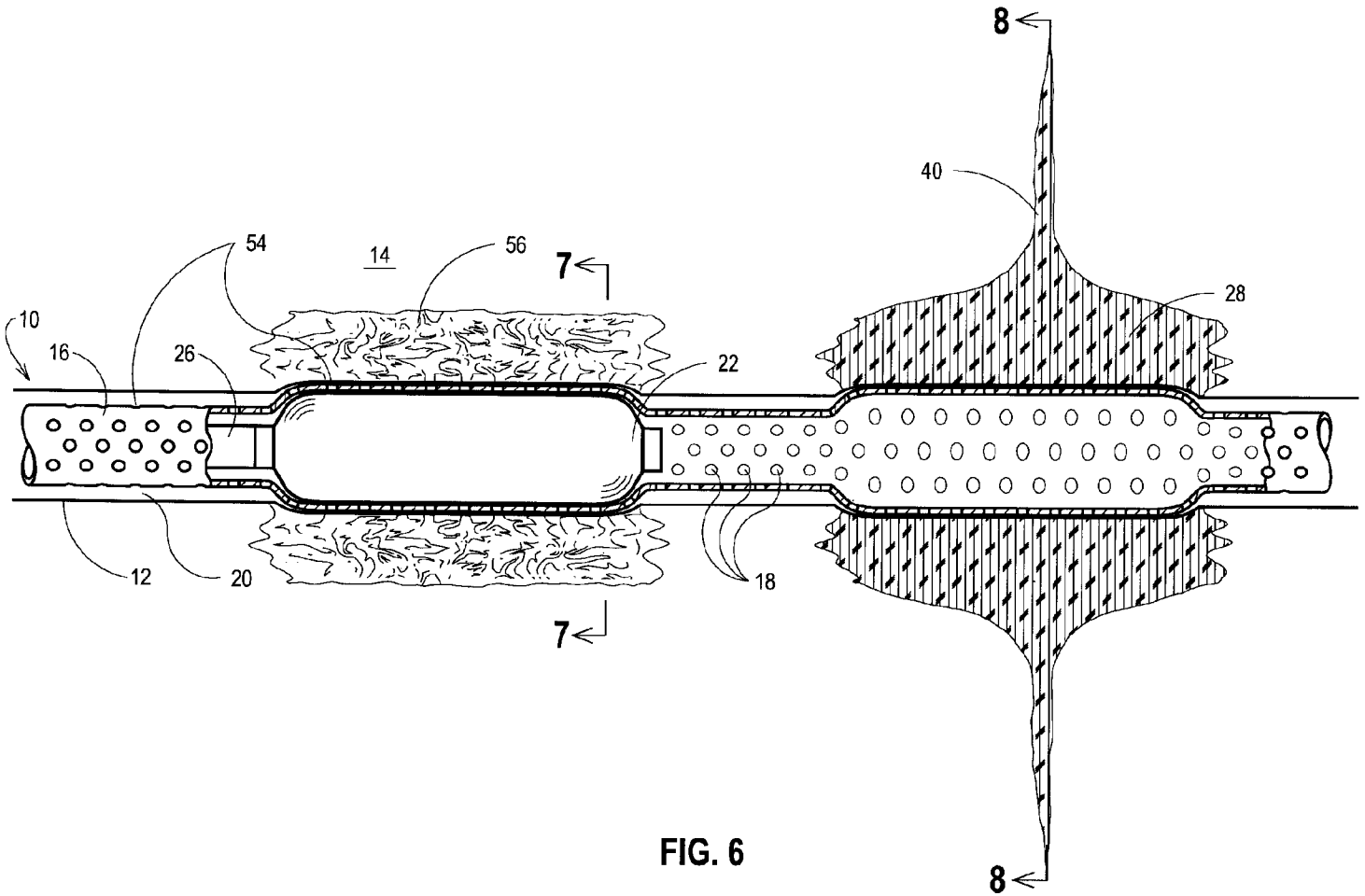
FIG. 6 is a schematic cross sectional view illustrating the step in the method of packer jack fracking the second interval using the packer to define a second packer fractured formation.
Figure 8:
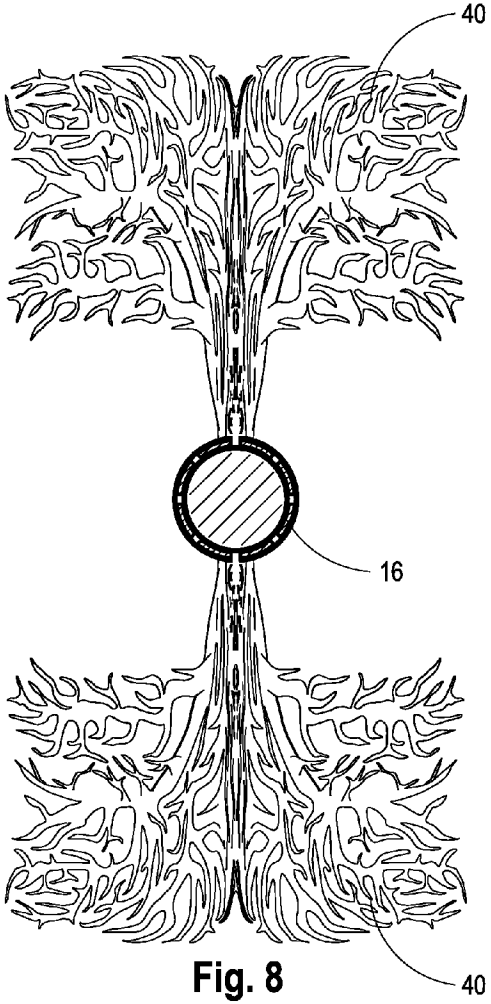
FIG. 8 is a schematic cross sectional view taken along section line 8-8 of FIG. 6 illustrating primary hydraulic fracs in the first hydraulically fractured formation.
Figure 7:
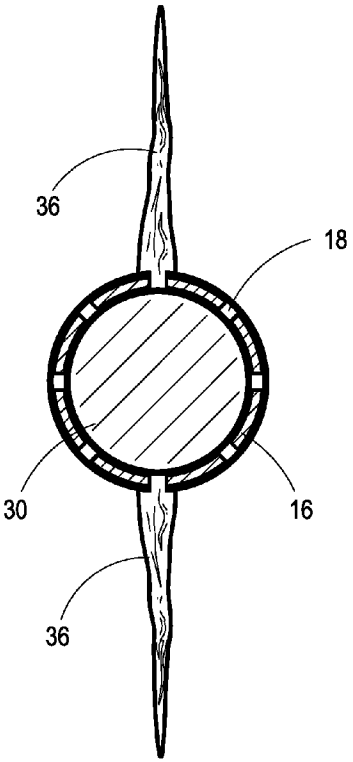
FIG. 7 is a schematic cross sectional view taken along section line 7-7 of FIG. 6 illustrating primary packer jack fracs in the second packer fractured formation.
Figure 8A:
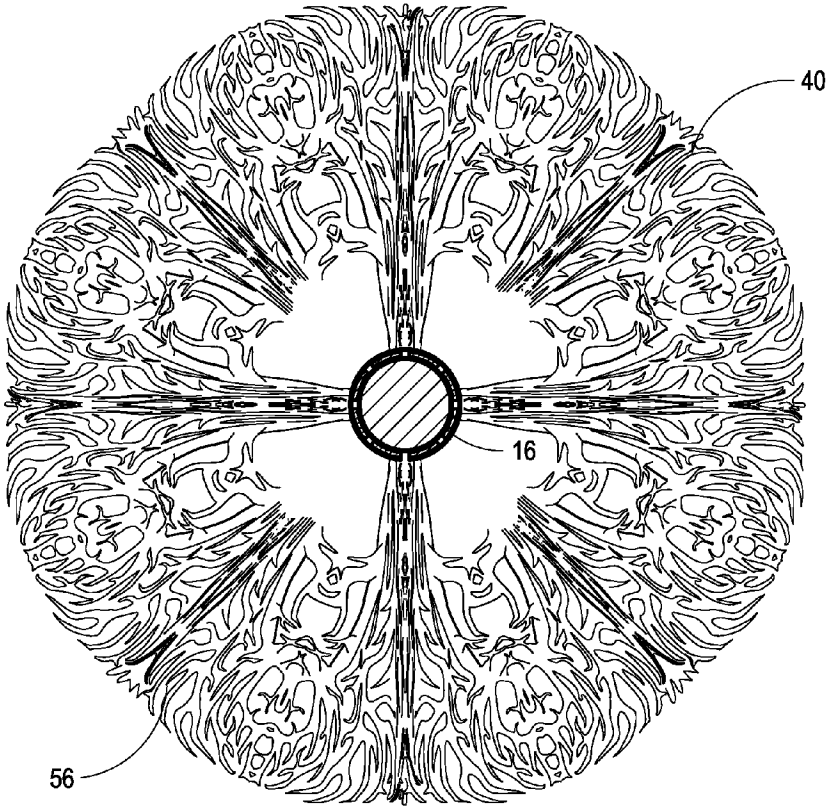
FIG. 8A is a schematic cross sectional view equivalent to FIG. 8 illustrating primary and secondary hydraulic fracs in the first hydraulically fractured formation.
Figure 7A:
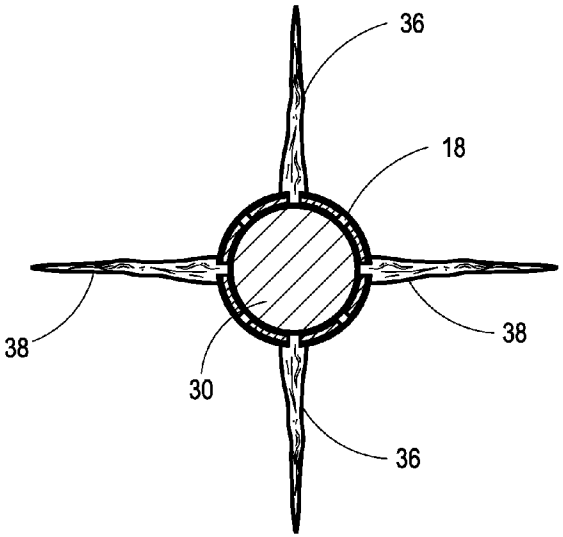
FIG. 7A is a schematic cross sectional view equivalent to FIG. 7 illustrating primary and secondary packer jack fracs in the second packer fractured formation.

Referring to FIG. 6, the system 54 includes the packer 22 and the perforated liner 16. As shown in FIG. 6, the method also includes the step of packer jack fracking the second interval 12 using the packer 22 to define a second packer fractured formation 56. This step can be performed as previously described for packer jack fracking of the first interval I1. FIGS. 7 and 7A illustrate the fracking fluid 30 being injected through the packer and into the primary packer jack fracs 36 and the secondary packer jack fracs 38 (FIG. 7A). FIGS. 8 and 8A illustrate the formation of the first hydraulically fractured formation 40 by injection of the fracking fluid 30 into the primary packer jack fracs 36 and the secondary packer jack fracs 38 (FIG. 7A) to form a plurality of hydraulic fractures 56 (FIG. 8A).

The hydraulically fracturing step (FIG. 5) can then be repeated as previously described to form a second hydraulically fractured formation in the second interval 12. In addition, the deflating and moving step (FIG. 4), the inflating step (FIG. 4), and the packer fracturing step (FIG. 3) of the method can then be repeated through as many intervals as is necessary.

Figure 9A:
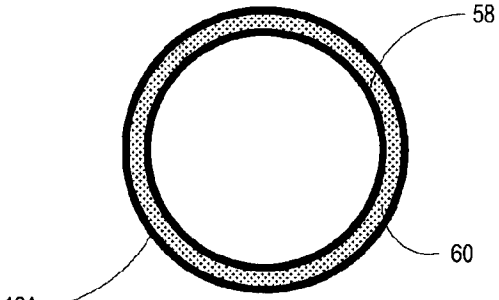
FIG. 9A is a cross sectional view taken along section line 9A-9A of FIG. 9.
Figure 9:
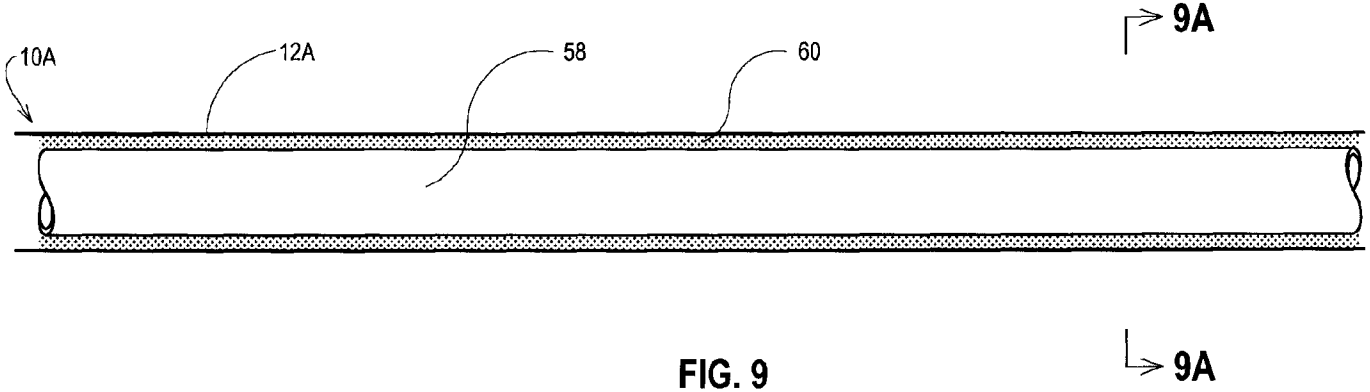
FIG. 9 is a schematic cross sectional view equivalent to FIG. 1 illustrating a step in an alternate method performed on a well having a liner cemented in the well bore.

FIGS. 9-15 illustrate steps in an alternate method for fracking and completing a well 10A. As shown in FIGS. 9 and 9A, the well 10A includes a well liner 58 cemented in a well bore 12A with cement 60.

Figure 10:
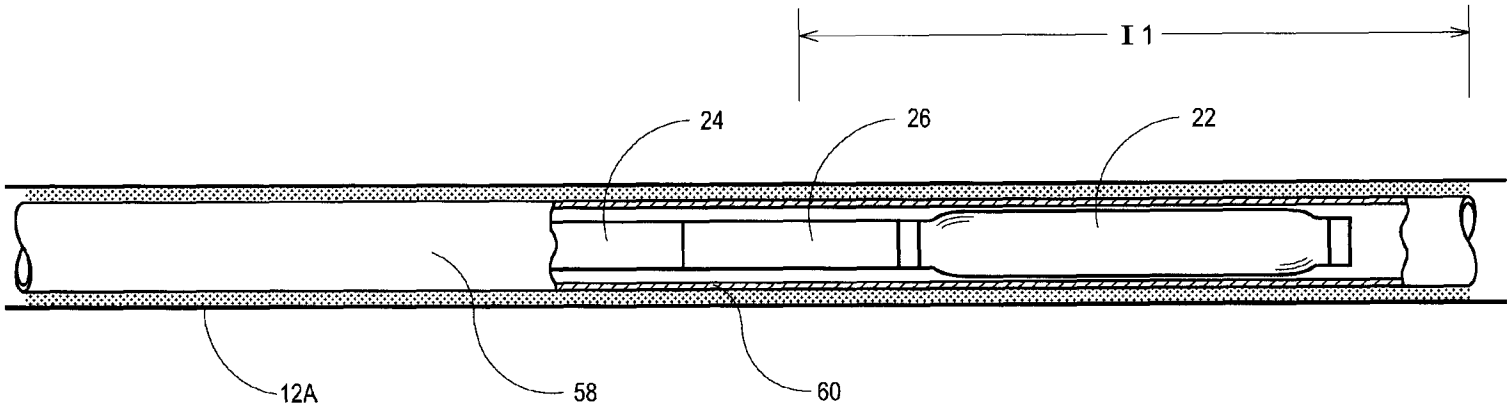
FIG. 10 is a schematic cross sectional view equivalent to FIG. 2 illustrating the step in the alternate method of installing a packer at a first interval of the formation.

Referring to FIG. 10, the alternate method also includes the step of installing the packer 22 in the liner 58 at a first interval I1 in the formation 14. This step can be performed substantially as previously described and shown in FIG. 2.

Figures 11, 11A:
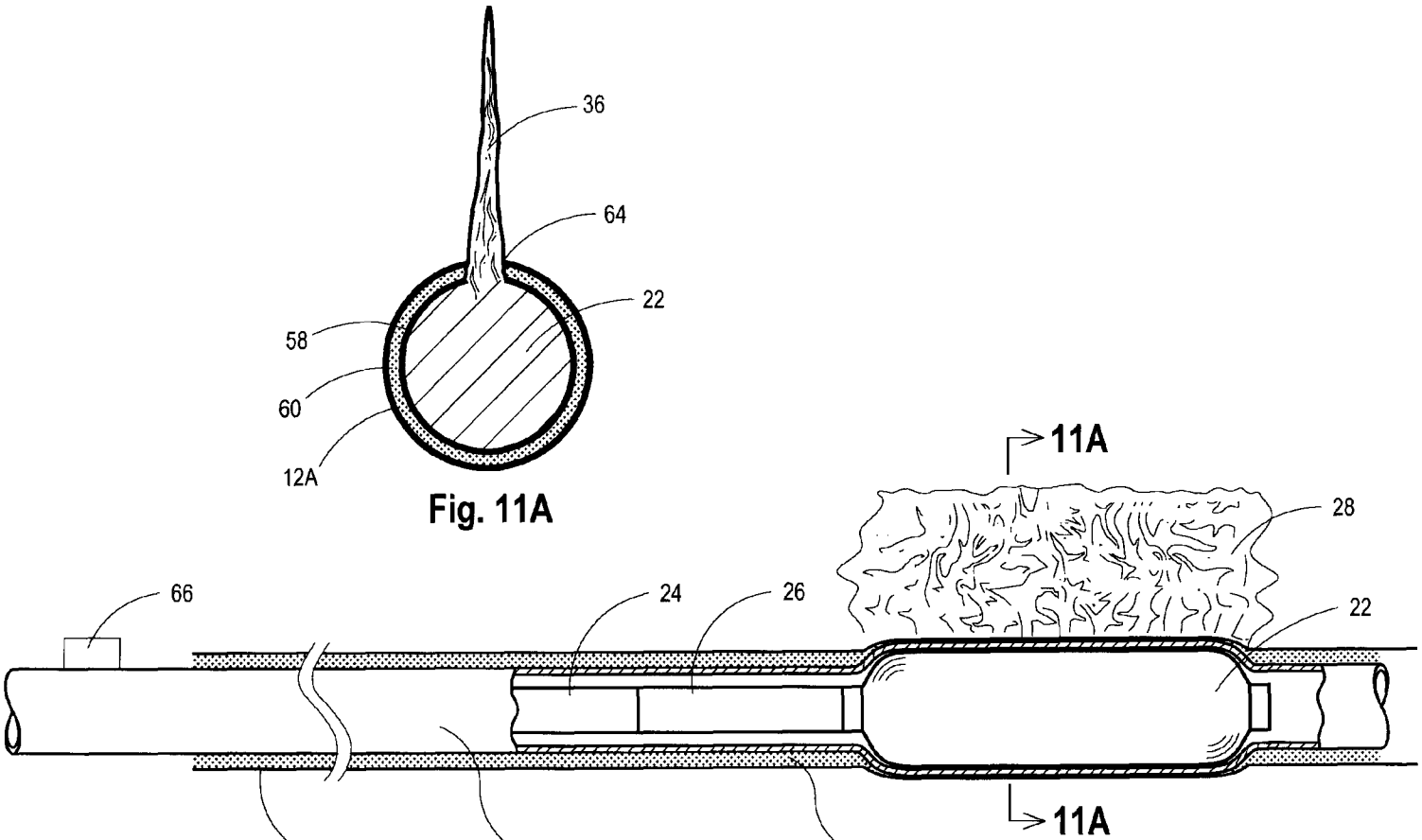
FIG. 11 is a schematic cross sectional view equivalent to FIG. 3 illustrating the step in the alternate method of breaking apart the cemented liner and packer jack fracking the formation using the packer to form a first packer fractured formation.
FIG. 11A is a schematic cross sectional view taken along section line 11A-11A of FIG. 11 illustrating an opening through the cemented liner and primary packer jack fracs in a first packer fractured formation.

Referring to FIGS. 11 and 11A, the alternate method also includes the step of breaking apart the liner 58 and the cement 60 to form at least one opening 64 through the liner 58 and the cement 60. Although for illustrative purposes only one opening 64 is shown, this step can be performed to form a plurality of openings 64 to provide multiple flow paths through the liner 58 and the cement 60. During this step the packer 22 also performs packer jack fracking of the first interval I1 to define the first packer fractured formation 28. This step can be performed substantially as previously described and shown in FIG. 3. As also shown in FIG. 11, a geophone 66 at the surface can be used to monitor the step.

Figures 12, 12A:
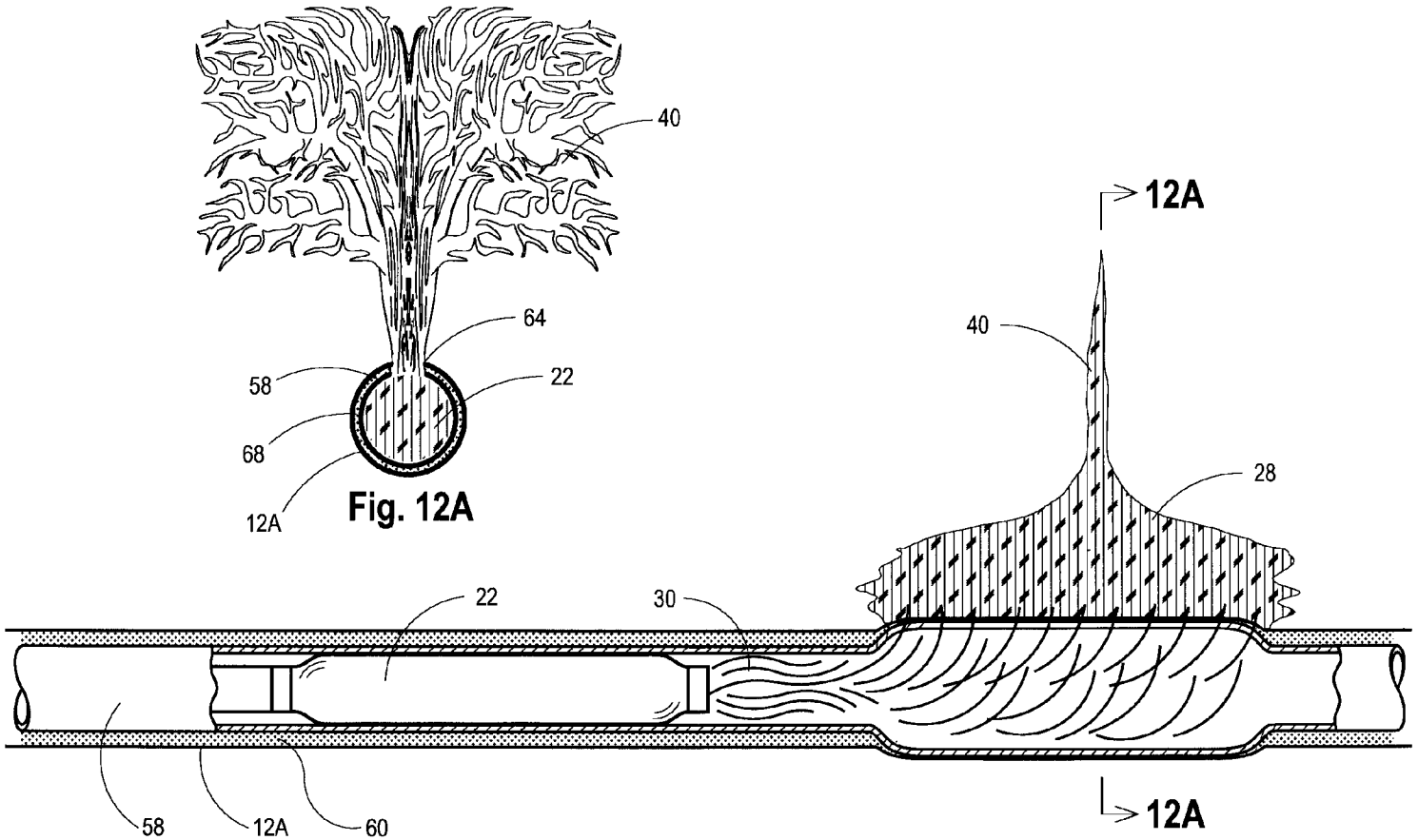
FIG. 12 is a schematic cross sectional view equivalent to FIGS. 4 and 5 illustrating the steps in the method of deflating and moving the packer to a second interval in the formation, inflating the packer to seal the bore hole, and hydraulically fracturing the first packer fractured formation by injecting a fracking fluid through the packer and the opening in the cemented liner to form a first hydraulically fractured formation.
FIG. 12A is a schematic cross sectional view taken along section line 12A-12A of FIG. 12 illustrating formation of the first hydraulically fractured formation.
Figure 13:
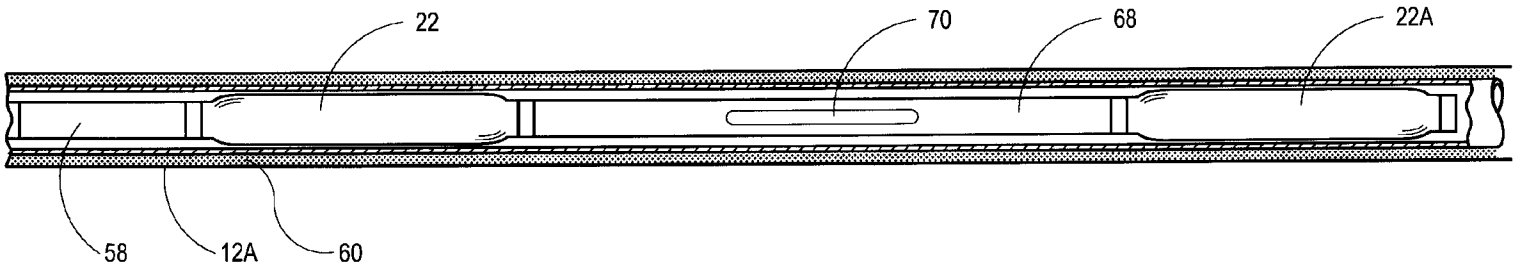
FIG. 13 is a schematic cross sectional view equivalent to FIG. 2 illustrating an optional step in the alternate method of using a second packer to seal the first hydraulically fractured formation.

Referring to FIGS. 12 and 12A, the alternate method also includes the step of deflating and moving the packer 22 to a second interval 12 in the formation 14 and inflating the packer 22 to seal the first packer fractured formation 28 for the subsequent hydraulic fracturing step. The packer 22 seals the up hole end of the well bore 12 proximate to the second interval 12. The down hole end of the well bore 12 can be unsealed, or optionally, as shown in FIG. 13, a second packer 22A can be used to seal the down hole end of the well bore 12. The second packer 22A can be attached to a tubular 60 having a slot 70 for providing a flow path for the hydraulic fracturing step.

As also shown in FIG. 12, the alternate method also includes the step of hydraulically fracturing the first packer fractured formation 28 by injecting the fracking fluid 30 through the packer 22 and the openings 64 in the liner 58 and the cement 60 to form a first hydraulically fractured formation 40. During this step, the fracking fluid 30 can be injected from the surface through the high pressure tubular 24, through the packer 22 and through the opening 64 in the liner 58 and the cement 60 into the first packer fractured formation 28. In addition to the fracking fluid 30, chemicals and proppants can also be injected into the first hydraulically fractured formation 40.

Figure 14A:
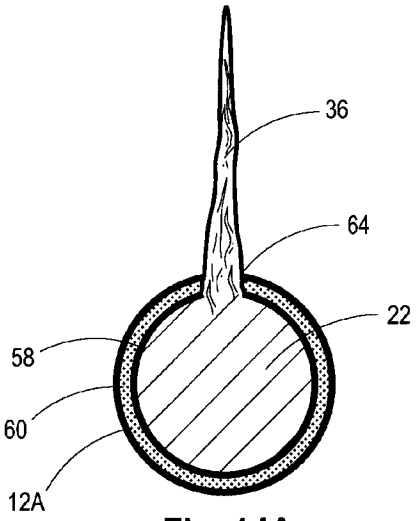
FIG. 14A is a schematic cross sectional view taken along section line 14A-14A of FIG. 14 illustrating formation of a second packer fractured formation.
Figure 14:
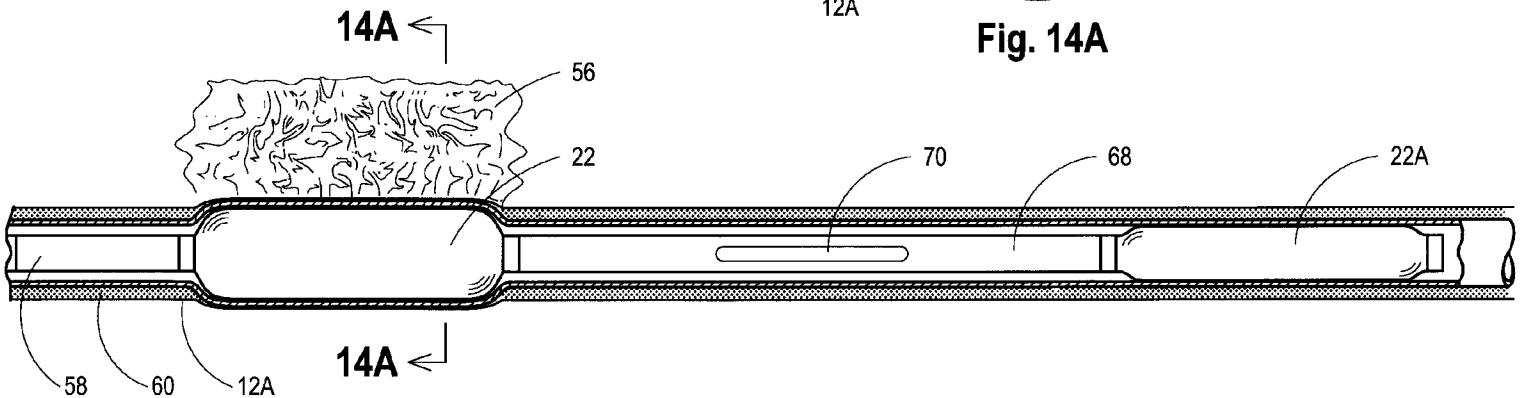
FIG. 14 is a schematic cross sectional view illustrating the step in the alternate method of packer jack fracking the second interval using the packer to define a second packer fractured formation.

Referring to FIGS. 14 and 14A, the alternate method also includes the step of packer jack fracking the second interval 12 using the packer 22 to define a second packer fractured formation 56. This step can be performed as previously described for packer jack fracking of the first interval I1.

Figure 15:
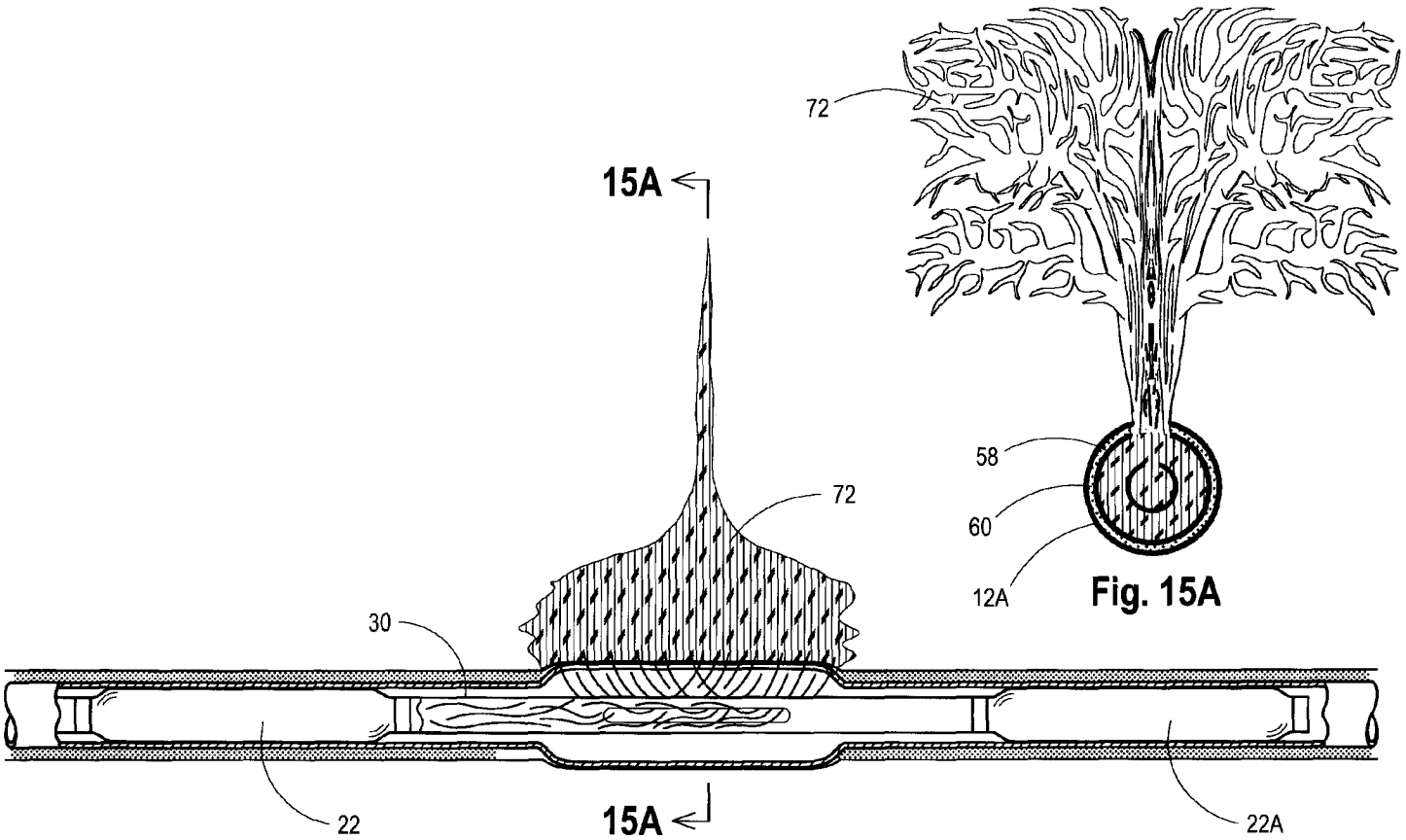
FIG. 15 is a schematic cross sectional view illustrating the step in the alternate method of hydraulically fracturing the second packer fractured formation by injecting a fracking fluid through the packer and the opening in the cemented liner to form a second hydraulically fractured formation.

Referring to FIGS. 15 and 15A, the alternate method also includes the step of hydraulically fracturing the second packer fractured formation 56 by injecting the fracking fluid 30 through the packer 22 and the openings 64 in the liner 58 and the cement 60 to form a second hydraulically fractured formation 72.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

What is claimed is:

1. A method for fracking and completing a well having a well bore through a formation comprising:

installing a perforated liner in the well bore having a plurality of pre-formed openings therethrough;

packer jack fracking a first interval in the formation and deforming the perforated liner into the formation using a packer to form a first packer fractured formation having a plurality of packer jack fracs in contact with the perforated liner;

deflating and moving the packer to a second interval in the formation;

inflating the packer to seal the first packer fractured formation;

hydraulically fracturing the first packer fractured formation by injecting a fracking fluid through the packer, through the openings in the perforated liner and into the packer jack fracs; and repeating the packer jack fracking step, the deflating and moving the packer step, the inflating the packer step and the hydraulically fracturing step through successive intervals of the formation.

2. The method of claim 1 wherein the inflating the packer step plastically deforms the perforated liner.

3. The method of claim 1 wherein the packer jack fracs include primary packer jack fracs and secondary packer jack fracs.

4. The method of claim 1 wherein the perforated liner includes hundreds of the openings per linear foot.

5. The method of claim 1 wherein the packer includes a plurality of grooves configured to provide a higher frictional force for anchoring the packer to the well bore or to the perforated liner.

6. The method of claim 1 wherein the inflating the packer to seal the first packer formation seals an up hole end of the packer fractured formation and further comprising sealing a downhole end of the packer fractured formation using a second packer.

7. A method for fracking and completing a well having a well bore through a formation comprising:

installing a perforated liner in the well bore having a plurality of pre-formed openings therethrough;

installing a packer in the perforated liner at a first interval in the formation;

packer jack fracking the first interval by deforming the perforated liner into the formation using the packer to define a first packer fractured formation having a plurality of packer jack fracs in contact with the perforated liner;

deflating and moving the packer to a second interval in the formation;

inflating the packer to plastically deform the perforated liner and seal the first packer fractured formation;

hydraulically fracturing the first packer fractured formation by injecting a fracking fluid through the packer, through the openings in the perforated liner, and through the packer jack fracs to form a first hydraulically fractured formation; and packer jack fracking the second interval using the packer to define a second packer fractured formation.

8. The method of claim 7 further comprising deflating and moving the packer to a third interval in the formation; inflating the packer to seal the second packer fractured formation; and hydraulically fracturing the second packer fractured formation by injecting the fracking fluid through the packer and the openings in the perforated liner to form a second hydraulically fractured formation.

9. The method of claim 7 further comprising repeating the deflating step, the inflating step, the hydraulically fracturing step and the packer jack fracturing step through a plurality of intervals.

10. The method of claim 7 further comprising sealing the first packer fractured formation using a second packer.

11. The method of claim 7 further comprising providing the packer with a plurality of grooves configured to increase a frictional force for anchoring the packer to the well bore or to the perforated liner.

12. A method for fracking and completing a well having a well bore through a formation and a liner in cement in a well bore comprising:

installing a packer in the liner at a first interval in the formation;

breaking the liner proximate to the first interval using the packer to form at least one first opening through the liner and the cement to provide a first flow path into the first interval;

packer jack fracking the first interval using the packer to define a first packer fractured formation;

deflating and moving the packer to a second interval in the formation;

inflating the packer to seal the first packer fractured formation;

hydraulically fracturing the first packer fractured formation by injecting a fracking fluid through the packer to form a first hydraulically fractured formation;

breaking the liner proximate to the second interval using the packer to form at least one second opening through the liner and the cement to provide a second flow path through the liner into the second interval; and packer jack fracking the second interval using the packer to define a second packer fractured formation.

13. The method of claim 12 further comprising deflating and moving the packer to a third interval in the formation; inflating the packer to seal the second packer fractured formation; and hydraulically fracturing the second packer fractured formation by injecting the fracking fluid through the packer to form a second hydraulically fractured formation.

14. The method of claim 12 further comprising repeating the deflating step, the inflating step, the hydraulically fracturing step and the packer jack fracturing step through a plurality of intervals.

15. The method of claim 12 further comprising sealing the first packer fractured formation using a second packer.

16. The method of claim 12 further comprising providing the packer with a plurality of grooves configured to increase a frictional force for anchoring the packer.

17. A system for fracking and completing a well having a well bore through a formation comprising:

a perforated liner configured for placement in the well bore having a plurality of pre-formed openings therethrough; and a packer in the perforated liner configured to deform the perforated liner and exert a mechanical jacking force on the formation and to packer jack frack and seal successive intervals in the formation, the packer comprising an inflatable element having a plurality of plies of reinforcing and an outer member having a plurality of grooves configured to increase a frictional force for anchoring the packer.

18. The system of claim 17 further comprising a second packer spaced from the packer and configured to seal the perforated liner during the packer jack frack.

19. The system of claim 18 further comprising a tubular having at least one slot attaching the second packer to the first packer.

20. The system of claim 19 wherein a diameter of the openings is ⅛ inch to ¾ inches and a density of the openings is less than 500 openings per linear foot.

* * * * *